United States Patent [19]

Van Hoye

[11] Patent Number: 4,707,881

[45] Date of Patent: Nov. 24, 1987

[54] LUGGAGE CASE AND WHEEL ROLLER OR CASTER ASSEMBLY THEREFOR

[75] Inventor: Willibald Van Hoye, Zwijnaarde, Belgium

[73] Assignee: Samsonite Corporation, Denver, Colo.

[21] Appl. No.: 867,187

[22] PCT Filed: Sep. 6, 1985

[86] PCT No.: PCT/EP85/00482

§ 371 Date: May 5, 1986

§ 102(e) Date: May 5, 1986

[87] PCT Pub. No.: WO86/01383

PCT Pub. Date: Mar. 13, 1986

[30] Foreign Application Priority Data

Sep. 6, 1984 [EP] European Pat. Off. ..... 84306082.3

[51] Int. Cl.[4] ..... B60B 33/00

[52] U.S. Cl. ..... 16/44; 16/29; 190/18 A; 267/201

[58] Field of Search ..... 16/29, 44, 45, 46, 47, 16/DIG. 36; 190/18 A, 37; 280/716; 267/63 R

[56] References Cited

U.S. PATENT DOCUMENTS

| | | | |
|---|---|---|---|
| 1,527,239 | 2/1925 | Vaughan et al. | 16/44 X |
| 1,876,812 | 9/1932 | Wiley et al. | 267/63 R X |
| 1,948,476 | 2/1934 | Saurer | 267/63 R X |
| 2,272,270 | 2/1942 | Krotz | 267/63 R |
| 3,163,268 | 12/1964 | Leavell | 190/18 A |
| 3,433,500 | 3/1969 | Christensen | 16/47 X |
| 4,188,048 | 2/1980 | Haung et al. | 16/44 X |
| 4,229,855 | 10/1980 | Rowe | 16/29 |
| 4,463,840 | 8/1984 | Seynhaeve | 190/18 A |
| 4,524,482 | 6/1985 | Mueller | 16/44 |

FOREIGN PATENT DOCUMENTS

| | | |
|---|---|---|
| 2833330 | 2/1980 | Fed. Rep. of Germany . |
| 3202007 | 8/1983 | Fed. Rep. of Germany . |
| 859184 | 12/1940 | France . |
| 2526112 | 4/1983 | France . |

*Primary Examiner*—Fred Silverberg

*Attorney, Agent, or Firm*—Gregory W. O'Connor

[57] ABSTRACT

A suitcase is provided with a rotating wheel 13 or roller mounted for rotation on axle 19. The axle 19 is secured to a resilient shock absorbing structure in the form of a disk of hard rubber 23, which in turn is secured to a mounting plate 24 fixed to the suitcase wall or shell 26. This arrangement allows vibrations resulting from contact of the wheel with the ground to be absorbed before they reach the case.

6 Claims, 7 Drawing Figures

LUGGAGE CASE AND WHEEL ROLLER OR CASTER ASSEMBLY THEREFOR

The present invention relates to luggage cases of the type that have wheels rollers, casters or other rotational ground engaging means projecting from their outer shell such that the case can be rolled on the ground engaging means for ease of transport.

A suitcase of this type is shown in GB No. 2030966A. In this arrangement a wheel housing is formed by walls integrally moulded with the shell of the suitcase. The ends of the axle of the wheel pass through and are supported by the walls.

An alternative arrangement is shown in GB No. 2116149A in which a wheel axle is secured to a plate which is attached by screws to the shell of the suitcase.

A disadvantage of the known arrangements is that the mounting of the wheels rollers or casters to the suitcase is rigid. When the suitcase is wheeled over a bumpy surface vibrations are transmitted from the rotational ground engaging means to the case resulting in noisy running and a liability for the mountings for the ground engaging means to be damaged.

According to the present invention in a first aspect an assembly for mounting a rotational ground engaging means to a case comprises an axle; ground engaging means mounted for rotation on the axle; mounting means for securing the assembly to the case, and resilient shock absorbing means, said shock absorbing means being secured on the one hand to the mounting means and on the other hand to the axle whereby in use with the assembly mounted on a case the shock absorbing means absorbs shocks from the ground engaging means.

With this arrangement vibrations resulting from contact of the ground engaging means with the ground are absorbed before they reach the case. If the case starts to sway the shock absorbers serve to damp the swaying movement. As a result, the case is easier and more convenient to handle when rolling on the ground engaging means, the case is less noisy, and there is less tendency for the mounting to be damaged.

Preferably the resilient shock absorbing means comprises a block of elastomeric material. For one particular design of case a rubber of Shore hardness 55 to 60 Shore A has been found suitable. Rubbers of different hardness will be found suitable for other cases depending on the size of the case and the load it is likely to have to carry. The smaller the case and load, the lower the hardness may be.

The inner end of the axle may be widened to provide an extended mounting surface to which the resilient shock absorbing means is fixed. Preferably the axle is secured via its resilient shock absorbing means to a mounting plate which is fixed directly to the case.

We have found that vulcanisation is a convenient way of ensuring that a good bonding is achieved between an elastomeric shock absorbing means and the mounting means on the one hand and the axle on the other. Other suitable means for securing the shock absorbing means may be used, for example adhesive or screws.

According to the present invention in a second aspect, there is provided a luggage case having a ground engaging means rotatably mounted about an axle, a resilient shock absorbing means secured on the one hand to the axle and on the other hand to an outer surface of the suitcase. The ground engaging means may be a wheel, a caster, a roller or the like.

Embodiments of the invention will now be described by way of example with reference to the accompanying drawings in which.

Figure 1:
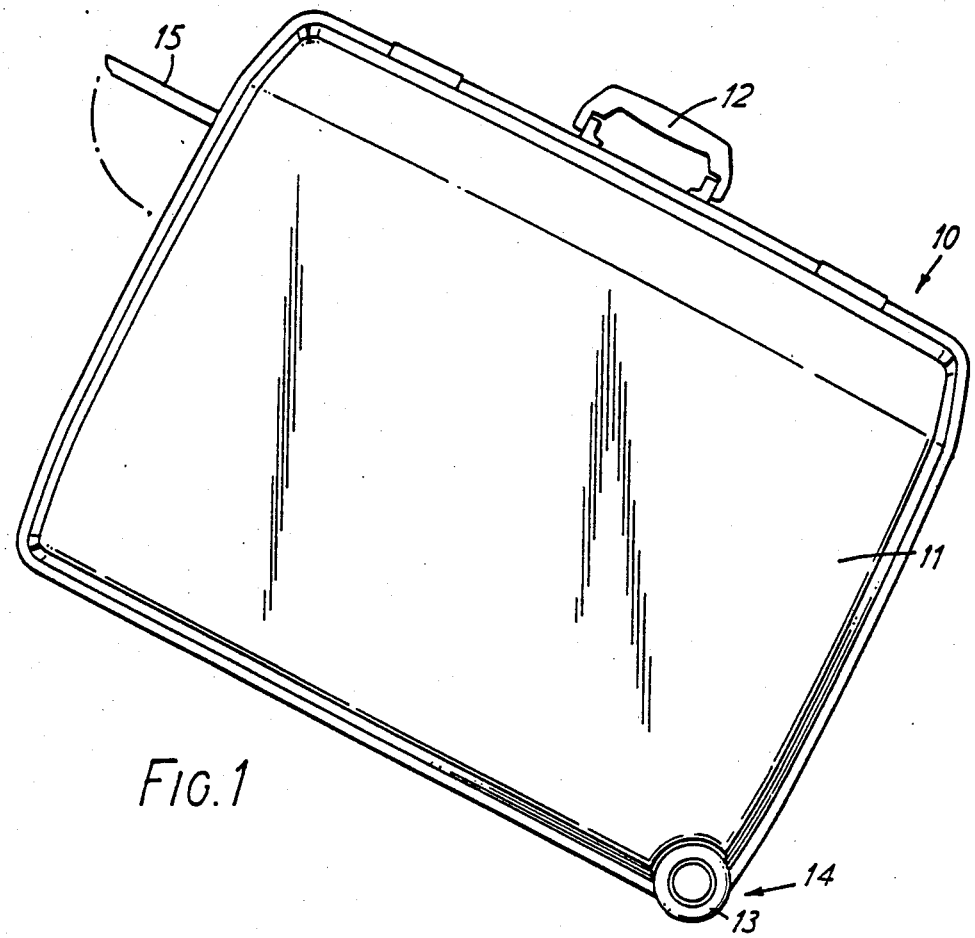
FIG. 1 is a side elevation of a suitcase fitted with a wheel assembly according to the invention.

Referring to the drawings, a suitcase 10 consists of a rigid shell 11 formed in two halves for example, of plastics material. The case has a carrying handle 12.

For ease of transport when heavily loaded, the case is also provided with a pair of wheels 13 at one of its lower corners 14 and a hinged steering handle 15. Normally the steering handle is folded flat against the wall of the suitcase but it can be hinged away from the case for steering the case when the case is being rolled on the wheels 13 at the lower corner.

The suitcase is provided, on either side at the corner 14, with a recess 16 which accommodates a respective one of the wheels 13.

Each wheel assembly consists of a wheel hub 17 with a tyre 18 at its rim.

The wheel hub 17 includes an outer rim **17*a* which, along with tyre 18, defines the overall axial width of wheel. Wheel hub 17 further includes a central axle sleeve 17*b* through which central axial opening 20 passes. The axle sleeve 17*b* terminates inwardly of the inner edge of the outer rim 17*a***.

The wheel is rotatably mounted on a cantilever stub shaft 19 which passes through central axial opening 20 in the wheel. The stub shaft has a circular flange 21 at its inner adjacent the axle sleeve **17*b* end and the wheel is held captive on the shaft by means of a clip 22** on the outer end of the shaft.

The stub shaft is secured by means of its flange 21 to a resilient shock absorbing means, in this embodiment a disc 23 of hard rubber. The disc in turn is secured to a generally sector shaped mounting plate 24.

The flange 21 is positioned laterally inward from the inner edge of the wheel, more specifically from the inner edge of the outer rim **17*a*. Thus, at least a portion of the disc 23** is positioned laterally within the overall axial width of the wheel.

The wheel assembly is secured in the recess to the wall of the suitcase for example, by means of rivets or screws 25 which pass through the mounting plate 24 and a portion of the suitcase wall 26.

The mounting plate 24 and the stub shaft 19 may be made of metal. The rubber shock absorbing member is preferably secured to the stub shaft and the mounting plate by vulcanising. The stub shaft and mounting plate are degreased and coated with a bonding agent. The parts are then placed in a mould and vulcanised. We have found that this technique produces a strong bond between the rubber disc 23 and the stub shaft and mounting plate. Alternatively the parts may be secured to the rubber shock absorbing member with a suitable adhesive or using screws which pass through the flange on the stub shaft and through the mounting plate into the rubber.

The rubber is a hard rubber having a Shore hardness of between 55 and 60 Shore A. The rubber must not bend too much otherwise the suitcase would be difficult to wheel because the wheels would rub against the wall of the case. On the other hand the rubber must be sufficiently soft to absorb shocks. The portion of the suitcase wall 27 which overhangs the wheels in the recess may be spaced sufficiently close to the rim of the wheel that if the suitcase is dropped on the wheels the deflection of the wheels about the resilient shock absorbing disc 21 causes the periphery of the wheel to make contact with the wall 28. In this way the suitcase wall may be designed to limit the maximum deflection of the wheel on its mounting, transferring some of the shock to the suitcase directly through the overhanging portion and preventing severe shocks causing damage to the wheel mounting. It will be appreciated that the rubber disc must be sufficiently hard to prevent the normal deflection of the stub shaft on its mounting when the suitcase is rolled on the ground from causing the wheel to come into contact with the overhanging portion 28 of the wall.

In the preferred embodiment the rubber disc 23 is 3 mm thick and 25 mm in diameter, although other suitable dimensions will work.

When the suitcase fitted with the wheel assembly as described above is rolled on the ground the resilient shock absorbing means formed by the rubber disc 23 absorbs vibration of the wheels and reduces the amount of vibration transmitted to the suitcase. This causes the amount of noise generated by the wheels to be greatly reduced and makes the suitcase more comfortable to roll. The resilient mounting also reduces the shocks on the stub shaft and the case mounting. In this way the stub shaft and mounting are less likely to be damaged. In suitcases where the axle passes through the wall of the suitcase it is necessary to reinforce the suitcase in the region of the wheel mounting in order to prevent damage in use. In the embodiment described above the axle does not pass through the suitcase wall and therefore this problem does not arise.

The shock absorbing mounting also tends to damp any swaying movement of the case which may start as the case is being rolled along, and thus prevent the suitcase getting out of control.

Figure 3:
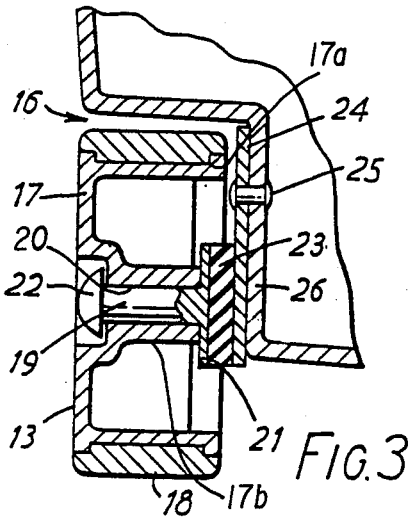
FIG. 3 is a cross section on the lines 3—3 of FIG. 2.
Figure 4:
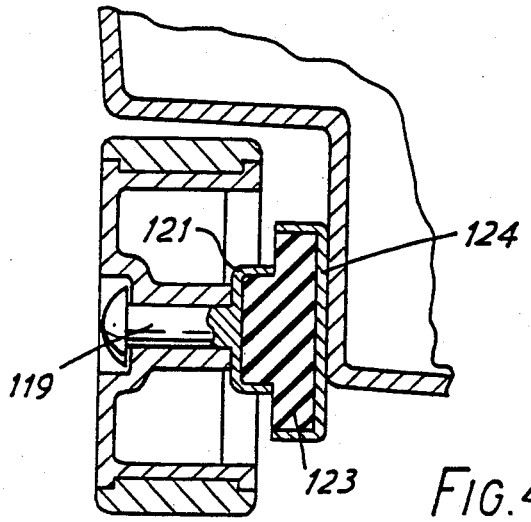
FIG. 4 is a cross section through a modified wheel assembly according to the invention.

Referring now to FIG. 4, this shows a modified form of mounting for a cantilever stub shaft. The resilient shock absorbing means in this embodiment comprises a block of hard rubber 123 has portions of two different diameters. The larger diameter portion is secured to the mounting plate 124 which is cup-shaped having a peripheral flange 130 which extends around the periphery of the larger diameter portion. The stub shaft 119 has a cup-shaped flange 121 which surrounds the smaller diameter portion. The shock absorbing rubber block 123 may be secured to the stub shaft and the mounting plate in any of the ways described in relation to the embodiment of FIGS. 1 to 3.

Figure 2:
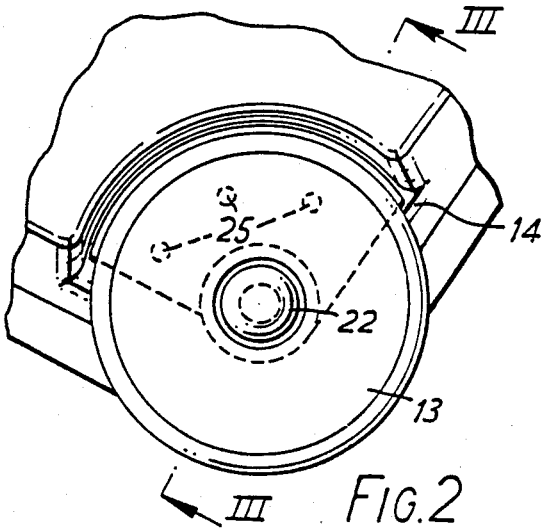
FIG. 2 is an enlarged detail of the wheel assembly of the case of FIG. 1.

Here, as in the embodiment of FIGS. 1 through 3, the flange 121 is positioned laterally inward from the inner edge of the wheel so that at least a portion of the resilient shock absorbing means is positioned laterally within the overall width of the wheel.

Figure 5:
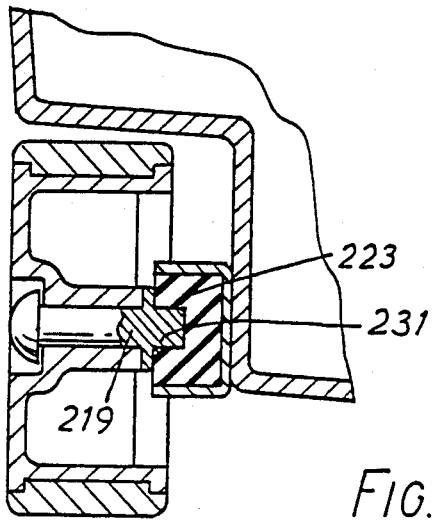
FIG. 5 is as cross section through another wheel assembly according to the invention.

In the embodiment of FIG. 5 the shock absorbing block 223 is disc-shaped with a central opening 231. The stub shaft 219 is secured in the opening 231. In other respects the embodiment is the same as that of FIG. 4 with at least a portion of the resilient shock absorbing means being positioned within the maximum width of the wheel.

Figure 6:
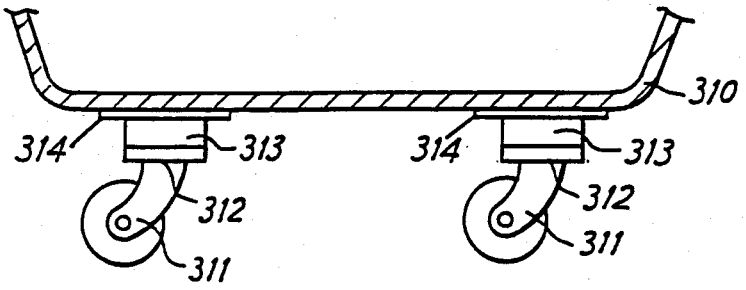
FIG. 6 is an elevation of caster assemblies in accordance with the invention attached to a case.

FIG. 6 shows an embodiment of the invention in which the ground engaging means are casters. Four casters are provided on the underside of the case 310 near each corner. Only two casters 311 can be seen in FIG. 6. Each caster has a flange 312 at its upper end which is secured to one face of a shock-absorbing block 313. The shock absorbing block is in turn secured to a mounting plate 314 which is fixed to the wall of the case for example, by screws or rivets. The block 313 and its method of attachment to the parts 312 and 314 can be as described in relation to the block 23 of FIGS. 1 to 3.

Figure 7:
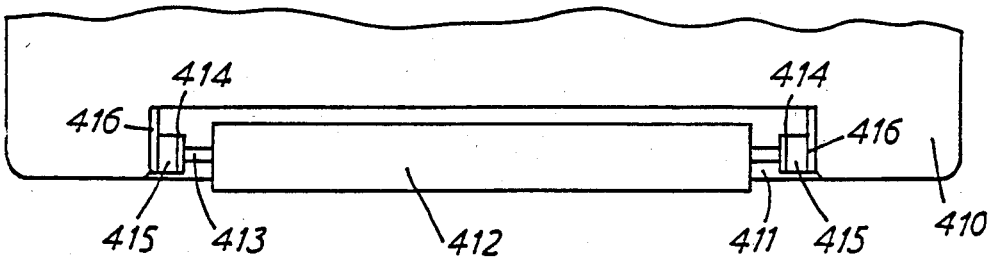
FIG. 7 is an elevation of a roller assembly in accordance with the invention attached to a case.

FIG. 7 shows the invention applied to a roller attached to the lower long side edge of a suitcase 410. A recess 411 is formed in the case and a roller 412 rotatable on an axle 413 is secured to the case in the recess. The roller axle has a radial flange 414 formed at each end. Each flange is secured on one face to a block 415 of hard rubber. The opposite face of each rubber block is secured to a respective mounting plate 416 which is secured to the case shell at the ends of the recess 411. The construction of the blocks 415 and the method of securing them to the other parts can be as described in relation to the embodiment of FIG. 1.

As with the other embodiments the resilient shock absorbing means absorb vibrations, reduce noise, and reduce the likelihood of severe shocks damaging the case or its mounting.

I claim:

1. A luggage case comprising a shell, said shell having recesses located at a corner, wheels rotatably mounted to said shell, said wheels being mounted at said corner of said shell on cantilever stub axles passing through the center of each wheel, each of said axles including a flange positioned laterally inward from the innermost edge of each said wheel, a resilient shock absorbing member attached to a surface of said flange, at least a portion of said resilient shock absorbing member being positioned laterally inward of the inner edge of said wheel and within the overall axial width of the wheel, said resilient shock absorbing member means being fastened in turn to a mounting plate for securing said wheel and axle to said shell such that said wheel is mounted in said recess in said shell a portion of the shell overhanging the ground engaging portion of said wheel, such that the spacing between the shell and the ground engaging portion of said wheel is less than the maximum deflection of the wheel and axle assembly about the resilient shock absorbing means, whereby the wheel makes contact with the over-hanging portion of the shell when the wheel is subjected to severe shock.

2. A case according to claim 1 characterized in that the resilient shock absorbing means is a piece of elastomeric material.

3. A case according to claim 2 wherein the elastomeric material is bonded to said mounting plate which, in turn, is secured to the outer surface of the shell.

4. A case according to claim 2 or 3 characterised in that the axle does not extend into the elastomeric material.

5. A case according to claim 3 characterised in that the resilient shock absorbing means is secured to the mounting plate by vulcanising.

6. A case according to claim 1 characterised in that the resilient shock absorbing means is secured to the flange by vulcanising.

* * * * *